US006253972B1

(12) United States Patent
DeVito et al.

(10) Patent No.: US 6,253,972 B1
(45) Date of Patent: Jul. 3, 2001

(54) LIQUID DISPENSING VALVE

(75) Inventors: Thomas P. DeVito, Santa Rosa; John McArdle, Rohnert Park, both of CA (US)

(73) Assignee: Golden Gate Microsystems, Inc., San Rafael, CA (US)

( * ) Notice: Subject to any disclaimer, the term of this patent is extended or adjusted under 35 U.S.C. 154(b) by 0 days.

(21) Appl. No.: 09/483,192

(22) Filed: Jan. 14, 2000

(51) Int. Cl.[7] ..... B67D 3/00

(52) U.S. Cl. ..... 222/504; 222/518; 222/571; 222/509; 251/335.3; 239/585.1

(58) Field of Search ..... 222/504, 509, 222/518, 571; 251/335.3, 335.1; 239/584, 585.1

(56) References Cited

U.S. PATENT DOCUMENTS

| | | | | |
|---|---|---|---|---|
| 3,132,775 | * | 5/1964 | Trumbull et al. | 222/504 |
| 4,579,255 | * | 4/1986 | Frates et al. | 222/518 |
| 4,962,871 | | 10/1990 | Reeves | 222/504 |
| 4,976,403 | * | 12/1990 | Bramblet | 251/214 |
| 5,405,050 | | 4/1995 | Walsh | 222/1 |
| 5,794,825 | * | 8/1998 | Gordon et al. | 222/504 |
| 5,875,922 | | 3/1999 | Chastine et al. | 222/1 |
| 6,032,832 | | 3/2000 | Dority et al. | 222/214 |

* cited by examiner

*Primary Examiner*—Kevin Shaver
*Assistant Examiner*—Frederick C Nicolas
(74) *Attorney, Agent, or Firm*—Thomas M. Freiburger

(57) ABSTRACT

A liquid valve particularly suited for dispensing of glue at high repetition rate has a solenoid-retracted pin that normally engages a valve seat to close the valve. Glue under pressure enters the chamber in which the pin operates, close to the valve seat. To seal against the flow of pressurized glue up along the pin toward the solenoid, and also to exert a light valve closing force on the pin, a thin metal bellows member is sealed and fixed to the pin near its lower end, at one end of the bellows, and to a connector within which the pin slides, at an opposite, upper end of the bellows. The geometry of the valve seat and the valve closure end of the pin is such that only a very slight retraction of the valve pin opens the valve sufficiently to deliver glue at full velocity through the valve orifice. The valve is capable of accurate glue dispensing through a wide range of operating pressure.

8 Claims, 4 Drawing Sheets

LIQUID DISPENSING VALVE

BACKGROUND OF THE INVENTION

The invention concerns liquid dispensing valves, and in particular a valve for dispensing liquid glue accurately and at high repetition rate.

Liquid dispensing valves with reciprocal valve pins operating against an orifice with a valve closure seat are well known. Typically such valves are retracted by a solenoid and urged toward closure by a spring. See, as examples, U.S. Pat. Nos. 5,875,922, 5,405,050, and 4,962,871. See also copending application Ser. No. 09/075,776, filed May 11, 1998, now U.S. Pat. No. 6,032,832, which shows a pressure-balanced glue dispensing valve requiring only a very small spring pressure for valve closure.

It is among of the objects of this invention to simplify the design and structure of a liquid dispensing valve while making the valve structure more rugged, reliable and long-lasting, particularly in a high repetition rate glue head for applying glue to paper or other materials in a production line. This is accomplished through use of a novel device that isolates glue or other liquid from leakage up the shank of a valve pin while also applying the requisite spring force to maintain the valve closed under a range of specified pressure conditions.

SUMMARY OF THE INVENTION

In the disclosed invention a liquid valve particularly suited for dispensing of glue at high repetition rate has a solenoid-retracted pin that normally engages a valve seat to close the valve. Glue under pressure enters the chamber in which the pin operates, close to the valve seat. To seal against the flow of pressurized glue up along the pin toward the solenoid, and also to exert a light valve closing force on the pin, a thin metal corrugated bellows member is sealed and fixed to the pin near the valve closing end of the pin, at one end of the bellows, and sealed and fixed to a housing element or fitting within which the pin slides, at an opposite, upper end of the bellows. The geometry of the valve seat and the valve closure end of the pin is such that only a very slight retraction of the valve pin opens the valve sufficiently to deliver glue at full flow velocity through the valve's orifice. The valve is capable of accurate glue dispensing through a wide range of operating pressure.

In a preferred implementation of the invention, a valve for dispensing liquid under pressure, and specifically, liquid glue under pressure in one embodiment includes a valve housing with a valve pin positioned in the housing for axial reciprocation. The pin has a valve closure end and an opposite end. At a downstream end of the valve housing is a valve orifice surrounded by a valve seat positioned essentially coaxial with the valve pin, for closure of the valve when the pin is engaged against the seat. The housing defines a liquid chamber upstream of the orifice and surrounding the valve pin near its valve closure end.

A bore to receive the pin in sliding engagement is provided in the housing, preferably via a pin slide fitting secured to the housing by threaded engagement, this fitting defining an end of the liquid chamber. The valve pin passes through the opening in the slide fitting for reciprocating sliding movement relative to the fitting.

An electromagnetic retraction device such as a solenoid is connected via its movable solenoid pin or plunger to the valve pin for axially retracting the pin away from the valve seat and opening the valve when power is applied to the retraction device. A liquid supply channel leads into the liquid chamber preferably from an oblique angle, and has an upstream end with means for connection to a supply of pressurized liquid, e.g. liquid glue.

An important feature of the invention is the bellows member, having an elongated shape with corrugations transverse to the length of the valve pin. This bellows member surrounds the valve pin and seals the liquid chamber from leakage along the valve pin as well as isolating most of the valve pin from the liquid. The bellows serves the additional important purpose of exerting a spring force on the valve pin sufficient to retain the valve pin in closed position against the seat under a preselected range of liquid pressure conditions.

In one preferred embodiment the bellows member exerts about 14.4 ounces of closure force on the valve pin, with the valve pin having a diameter of about 3/64 inch and the bellows having an outside diameter of about 0.11 inch.

DESCRIPTION OF PREFERRED EMBODIMENTS

Figure 1:
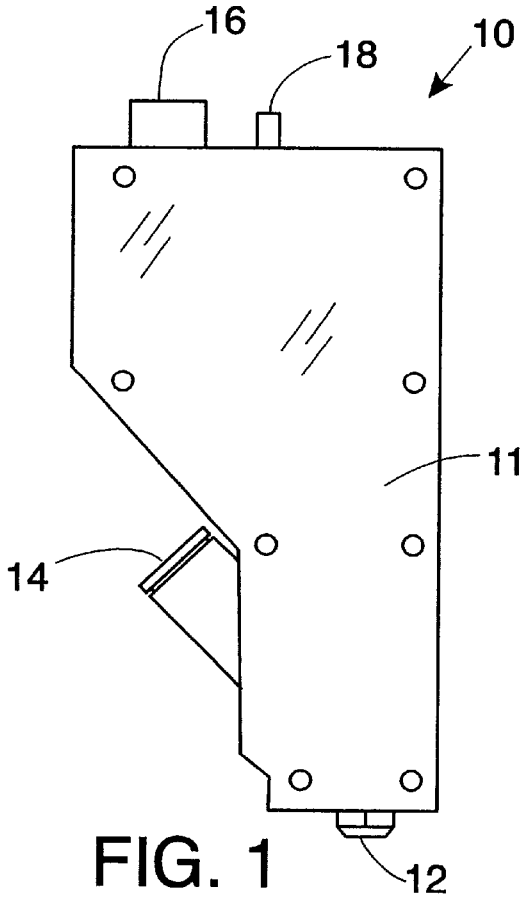
FIG. 1 is a side elevation view of a liquid dispensing valve, preferably a glue head, according to a preferred embodiment of the invention.
Figure 2:
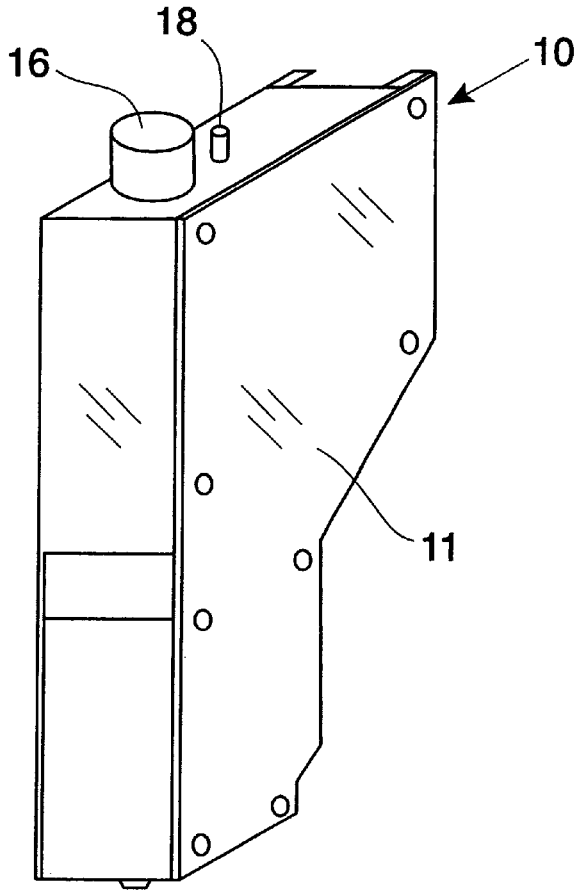
FIG. 2 is a perspective view of the valve or glue head.

In the drawings, FIGS. 1 and 2 show a liquid dispensing valve, preferably a glue head 10 having a housing 11, a dispensing nozzle 12, a connector 14 to be connected to a source of pressurized liquid, an electrical connector port 16 and an electrical momentary switch which initiates a purge or flushing operation at a programmable frequency (under control of a controller, not shown). In one preferred embodiment the housing 11 is no more than about 1½ inches wide, about 2¼ inches tall and no more than about ½ inch in thickness. The nozzle 12 has an orifice with a small diameter, which may be about 0.01 inch for dispensing adhesives.

Figure 3:
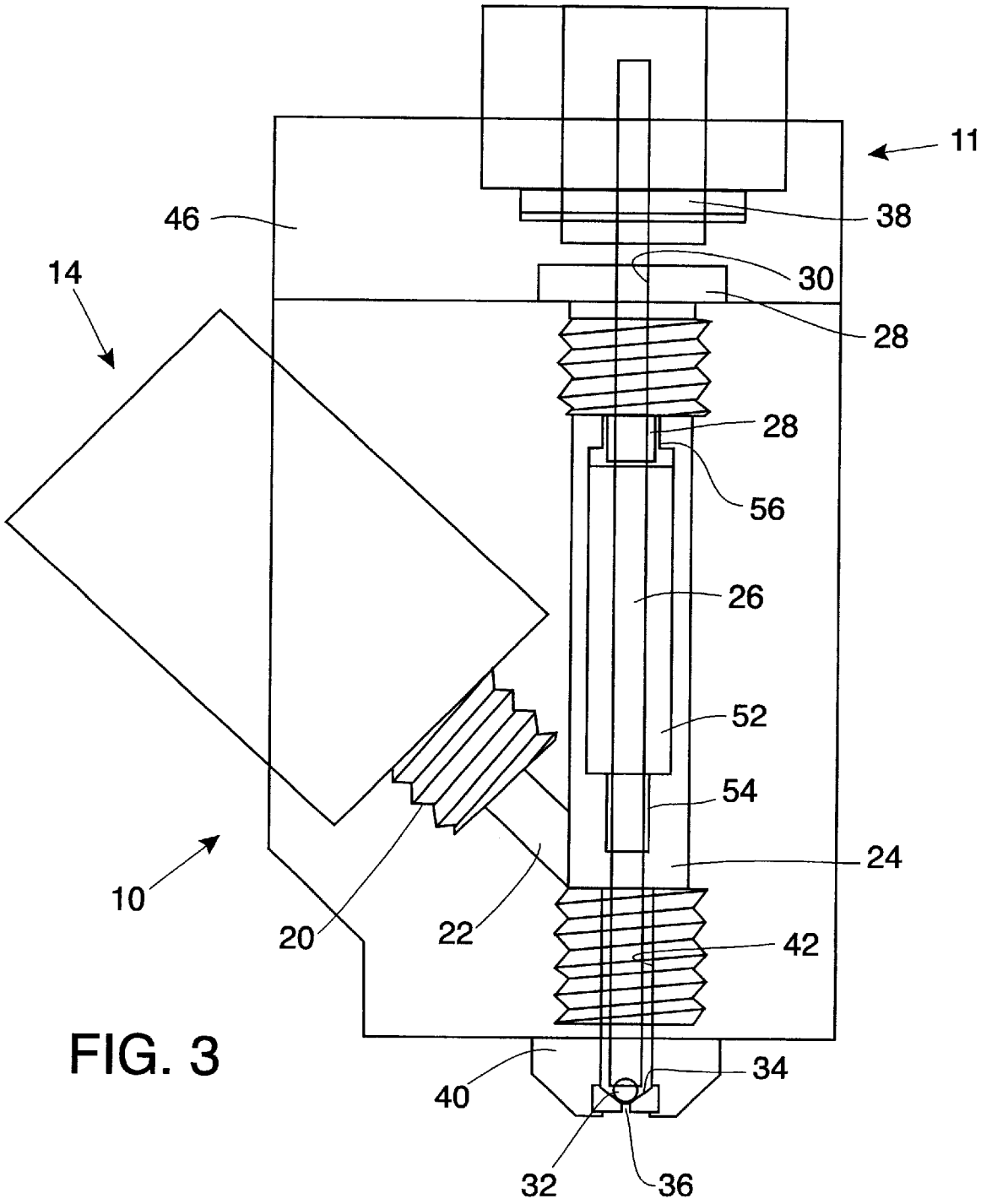
FIG. 3 is a sectional view showing a valve slide pin, liquid chamber, valve seat and a bellows member secured to the valve pin, all within a lower housing of the valve unit.
Figure 4:
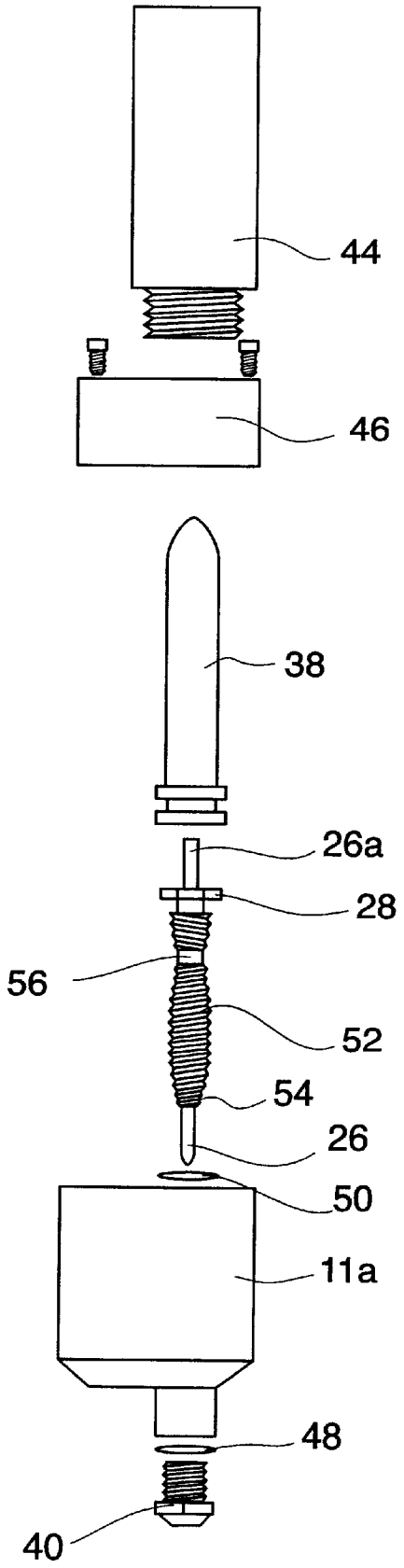
FIG. 4 is an exploded view showing components of the liquid dispensing valve.
Figure 5:
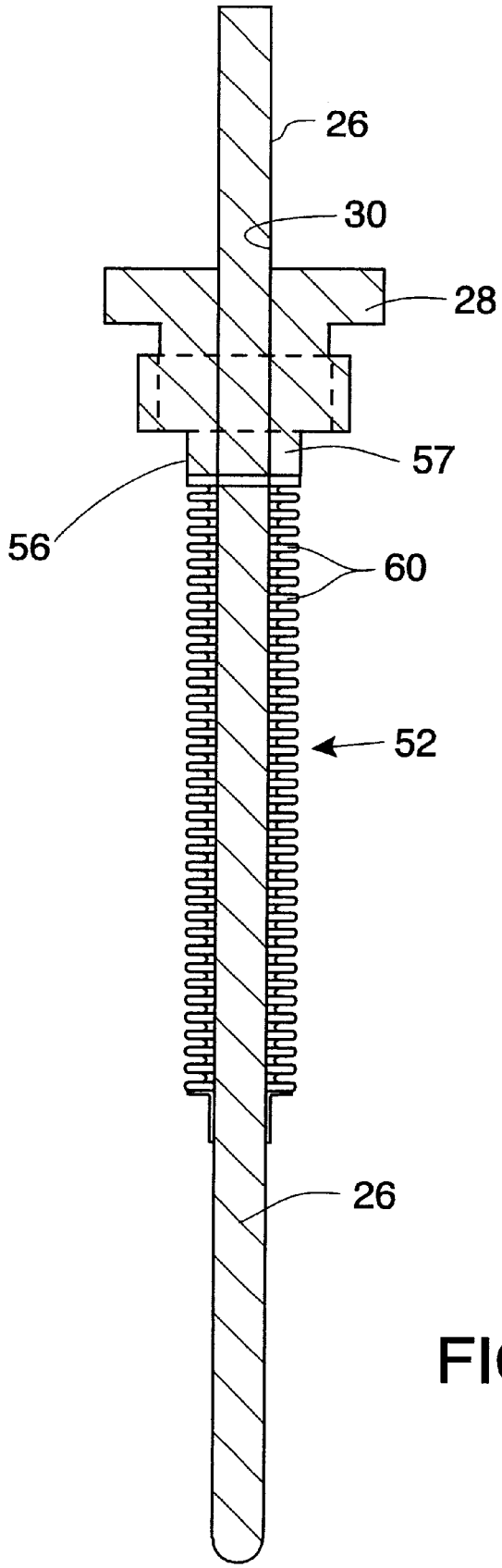
FIG. 5 is a detailed view showing the bellows member, the valve pin and a slide fitting through which the valve pin is slidable.

FIGS. 3, 4 and 5 show details of the valve and its components within the housing. A lower portion 11*a* of the housing 11 is shown in FIG. 3, greatly enlarged, revealing the connection 14 for pressurized liquid (e.g. liquid glue), with a threaded fitting 20 and a conduit 22 leading to a downstream region of the lower housing 11*a*. The conduit 22, preferably formed in the casing of the housing 11*a*, leads into a liquid chamber 24 within which the valve operates.

The opening and closing of the valve is effected by a valve pin 26 which reciprocally slides axially within the housing. The pin 26 is slidable within a housing fitting 28, preferably a threaded fitting which is secured into complementary threads of the housing. The fitting has a central bore 30 through which the pin 26 is freely slidable. A lower end 32 of the pin 26 preferably is rounded, approximately hemispherical, for engagement against a valve seat 34 at the center of which is a liquid dispensing orifice 36.

At the upper end of the lower housing 11, the pin 26 extends outwardly and is fixedly secured in the end of a reciprocable solenoid plunger 38, for reciprocable movement along with the plunger.

The slide bore 30 for the pin, enabling the pin to slide through the upper end of the liquid chamber, can be provided by structures other than the threaded fitting 28. The bore could be in an end cap (not shown) forming the upper end of the lower housing 11*a,* for example. Thus, the term pin slide fitting is intended to refer to a part of the housing, whether it be a threaded member as shown or another structure with provision to receive the pin 26. The housing portion or fitting must have ability to receive the end of a bellows member as described below.

At the outlet end of the lower housing 11*a,* the orifice and valve seat form part of a threaded nozzle unit 40 which screws into the bottom of the lower housing as indicated. The nozzle unit 40 has an internal bore 42, considerably larger than the outer diameter of the valve pin 26, thus forming a part of the liquid chamber 24 within which the pressurized glue (or other liquid to be dispensed) is contained.

FIG. 4 shows the major components of the valve assembly in exploded view. The pin 26 is shown, positioned to extend through the slide fitting 28, and with an upper end 26*a* of the pin extending to a connection with the solenoid plunger 38. For this connection the lower end of the plunger may have a center bore, with threaded openings lateral to the center bore for receiving set screws (not shown) to engage the sides of the upper portion 26*a* of the pin. Above the solenoid plunger 38 is shown a solenoid 44, within which the plunger is reciprocal when the unit is assembled. A block cap 46 also shown in FIG. 3 fits down over the solenoid plunger and engages with the lower housing section 11*a* upon assembly.

As indicated in FIG. 4, a gasket such as an O-ring 48 may be positioned between the lower end of the bottom housing section 11*a* and the nozzle 40, and another such gasket 50 is used to seal the assembly of the slide fitting 28 with the lower housing section 11*a*.

Pursuant to this invention the liquid in the liquid chamber is sealed and isolated from contact with most of the length of the valve pin, and from migrating or leaking along the valve pin 26 into and through the slide fitting 28, by an important element which serves two purposes. A bellows element 52, very thin-walled and precision-formed, is secured in fixed and sealed relationship to the valve pin at a lower end, at 54, and to the slide fitting 28 at an upper end, at 56. This bellows device 52 is also shown, along with the slide fitting 28 and the valve pin 26, in FIG. 5. In FIG. 5 the slide fitting 28 is seen as having a collar 57 to which the bellows end 56 is secured.

In addition to isolating the pin and the slide fitting's bore 30 from the pressurized liquid in the chamber 24, the bellows unit 52 also supplies the requisite spring force to hold the valve closed (by engaging the pin 26 with adequate force against the valve seat 34) through a desired range of liquid pressures. For example, for a preferred embodiment wherein the valve pin has a diameter of about 0.047 inch, and wherein the bellows has an outside diameter of about 0.1 inch, and where an operating pressure of about 20 to 120 psi in liquid glue is specified, the bellows exerts a spring force of about 14.3 ounces against the pin to assure valve closure at the valve seat 34. This counters the glue (or other liquid) pressure, which tends to place a biasing force toward opening of the valve, due to the geometry of the components involved. A closure force of 14.36 ounces will assure that, for the sizes mentioned above, the valve will remain securely closed under that specified range of operating pressure, and theoretically up to about 170 psi.

This spring force is achieved by establishing the bellows at a relaxed position at a preselected pin position beyond the valve seat. In a preferred embodiment, that relaxed position is defined about 0.025 inch beyond the valve seat, so that when the nozzle unit is secured into the valve assembly, the valve pin and bellows are forced back sufficiently to create the 14.36 ounces of force for the embodiment described. It is somewhat important that the closure force not be much greater than the minimum needed, because greater force can tend to inhibit the operation of the valve in very rapid valve opening and closing situations.

The bellows device 52 preferably is of the general type which has previously been used for contact pads in electrical switches, and in a varied form, for angular drive shafts. These bellows are formed by electro-deposition of metal onto a form which is later chemically dissolved away. The bellows typically are formed primarily of nickel. The wall thickness in a preferred embodiment may be about 0.0018 inch, and a preferred embodiment of the bellows is formed with 36 grooves (identified at 60), with a convolution pitch of about 0.015 inch. The stroke of the valve pin 26 in an opening/closing cycle is extremely small (preferably about 0.01 to 0.015 inch, since only a very small retraction from the valve seat 34 is required to provide sufficient flow area to admit liquid through the small orifice (e.g. 0.003 to 0.02 inch) of the nozzle. At this short stroke, the bellows device is prescribed to have an almost unlimited cycle life, over $10^9$ cycles.

The pin 26 in a preferred embodiment comprises a stainless steel dowel pin, which may be of 3164 stainless, formed precisely and very straight. Such dowel pins have previously been used as assembly guides.

The spring force of 14.36 ounces is calculated to assure closure of the valve at pressures beyond design pressures, e.g. beyond about 170 p.s.i. It is achieved in the particular embodiment described by preloading the bellows 0.025 inch, the bellows having a spring constant of 35.9 lb./inch, for a force of 0.8975 lb.

Therefore, the bellows device 52 is seen as serving the important dual purposes of sealing the sliding components of the assembly from the pressurized liquid within the liquid chamber 24, thus preventing leakage back along the valve pin 26; and providing a spring force which is just enough to maintain the valve securely closed under the prescribed operating pressures. The result is a highly reliable liquid dispensing valve, particularly for use as a glue head in rapid glue application processes such as in a production line where dots or lines of glue are applied to paper or other material to be folded and assembled.

The terms "upper", "lower", "above", "below", etc. are intended as convenient references to describe the invention in the orientation depicted in the drawing, and not to limit the orientation of the dispensing valve to the vertical, orifice-down position shown. The valve device can be used in other orientations.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

What is claimed is:

1. A valve for dispensing liquid under pressure, comprising:

a valve housing, a valve pin positioned in the valve housing for axial reciprocation, the pin having a valve closure end and an opposite, upper end, a valve orifice at a downstream end of the valve housing, a valve seat adjacent to the valve orifice and positioned essentially coaxial with the valve pin, for closure of the valve when the valve pin is engaged against the valve seat, and the housing defining a liquid chamber upstream of the orifice and surrounding the valve pin near its valve closure end, a pin slide fitting in the housing and defining an end of the liquid chamber, the valve pin passing through an opening in the slide fitting for reciprocating sliding movement relative to the fitting, electromagnetic retraction means connected to the valve pin for axially retracting the pin away from the valve seat and opening the valve when power is applied to the retraction means, a liquid supply channel leading into the liquid chamber and having an upstream end with means for connection to a supply of pressurized liquid, and a bellows member having corrugations oriented transversely to the axial direction of the valve pin, the bellows member being positioned in surrounding relationship to the valve pin and having one end secured to the valve pin in sealed relationship near the downstream end of the valve housing and an opposite end secured in sealed relationship to the pin slide fitting through which the valve pin is reciprocal, the bellows exerting a spring force on the valve pin sufficient to retain the valve pin in closed position against the valve seat under a preselected range of liquid pressure conditions in the liquid chamber, while also providing a seal against leakage of the pressurized liquid along the pin, toward the retraction means.

2. The apparatus of claim 1, wherein the bellows member exerts about 14 ounces of closure force on the valve pin, and wherein the valve pin has a diameter in the range of about 0.04 inch to 0.05 inch and the bellows has an outside diameter of about 0.1 inch.

3. The apparatus of claim 1, wherein the pin slide fitting comprises a screw threaded fitting with a central bore as said opening, and the pin slide fitting having a collar over which said opposite end of the bellows is secured.

4. The apparatus of claim 2, wherein the preselected range of pressure includes pressure up to about 170 psi.

5. The apparatus of claim 1, wherein the liquid supply channel contains liquid adhesive under pressure.

6. The apparatus of claim 1, wherein the valve closure end of the valve pin is approximately hemispherical in shape.

7. The apparatus of claim 6, wherein the valve seat is formed essentially as a portion of a cone, with approximately 110° interior angle in the cone.

8. The apparatus of claim 1, wherein the valve orifice has a diameter of about 0.003 inch to 0.02 inch.

* * * * *